US006427487B1

(12) United States Patent
Morgan

(10) Patent No.: US 6,427,487 B1
(45) Date of Patent: Aug. 6, 2002

(54) INTERCHANGEABLE JEWELRY ITEM

(76) Inventor: Allison Morgan, 3008 N. Woodbridge Rd., Birmingham, AL (US) 35223

( * ) Notice: Subject to any disclaimer, the term of this patent is extended or adjusted under 35 U.S.C. 154(b) by 0 days.

(21) Appl. No.: 09/565,883

(22) Filed: May 5, 2000

(51) Int. Cl.[7] ..... A44C 17/02
(52) U.S. Cl. ..... 63/29.1; 63/40; 63/19
(58) Field of Search ..... 63/29.1, 40, 20, 63/1.16, 30, 19

(56) References Cited

U.S. PATENT DOCUMENTS

| | | | | |
|---|---|---|---|---|
| 439,139 | A | | 10/1890 | Gaynor |
| 441,425 | A | * | 11/1890 | Lehr |
| 690,095 | A | | 12/1901 | Bleaden |
| 1,182,534 | A | | 5/1916 | Driggott |
| 1,566,976 | A | | 12/1925 | Schmidt |
| 1,712,171 | A | * | 5/1929 | Rochas |
| 2,072,440 | A | | 3/1937 | Bauer et al. |
| 2,147,740 | A | | 2/1939 | Gruber |
| 2,519,152 | A | | 8/1950 | Piotrowski |
| 2,674,107 | A | * | 4/1954 | Bodnar |
| 2,811,024 | A | | 10/1957 | Thompson |
| 2,860,395 | A | * | 11/1958 | Anderson |
| 3,192,737 | A | * | 7/1965 | Schechter et al. |
| 3,543,535 | A | * | 12/1970 | Siegel et al. |
| 3,568,467 | A | * | 3/1971 | Ellison |
| 3,739,598 | A | | 6/1973 | Postel |
| 4,374,470 | A | | 2/1983 | Isaacson |
| 4,488,415 | A | | 12/1984 | Jenkins |
| 4,726,200 | A | * | 2/1988 | Carter ..... 63/15 |
| 4,742,696 | A | | 5/1988 | Jenkins |
| 4,794,766 | A | | 1/1989 | Schunk et al. |
| 5,253,490 | A | | 10/1993 | Doganay |
| 5,375,434 | A | | 12/1994 | Wertheimer |
| 5,414,948 | A | | 5/1995 | Kudo |

* cited by examiner

*Primary Examiner*—Anthony Knight
*Assistant Examiner*—Alison K. Pickard
(74) *Attorney, Agent, or Firm*—Levisohn, Lerner, Berger & Langsam LLP

(57) ABSTRACT

A jewelry device having interchangeable ornaments is provided. A main base of the device has a recess adapted to receive a removable ornament. The main base has a flange formed on an interior of the top side within the recess. The flange retains an ornament and prevents it from falling out of the top of the device. A securing door is attached to the bottom side of the main base. The securing door has a top side facing the recess and a bottom side opposite the top side. The securing door is movable between a closed position substantially in contact with the main base and an open position. A leaf spring is attached to the top side of the securing door. The spring is adapted to bias against a removable ornament disposed in the recess when the securing door is in the closed position and thus prevent it from rattling, becoming misaligned, or falling out. The device also contemplates the use of multiple ornamental inserts for disposal within the recess of the main base.

17 Claims, 6 Drawing Sheets

INTERCHANGEABLE JEWELRY ITEM

BACKGROUND OF THE INVENTION

1. Field of the Invention

The invention is related to jewelry. More particularly, the invention is related to jewelry devices having removable and interchangeable ornaments.

2. Description of the Related Art

It is often desired to be able to change or replace the main ornamental device in a piece of jewelry. A wearer may become bored having a single, immutable piece of jewelry, or the ornament may become damaged. Alternatively, the wearer might like to accessorize the jewelry with her clothing and match an ornament to the color or colors she is wearing without purchasing a lot of jewelry.

Several devices that allow for the removal and replacement of ornaments from jewelry are known. U.S. Pat. No. 439,139 to Gaynor describes a setting for coins to be worn as a pin or brooch. A coin is fitted into a front portion of the setting and the backing is screwed onto the back of the setting. A washer may be employed to prevent smaller coins from falling out of the front display hole in the setting. U.S. Pat. No. 690,095 to Bleaden teaches a ring having a removable stone and a sliding door that fits behind the stone and secures it to the ring. U.S. Pat. No. 1,182,534 to Driggott describes a gem setting for a ring. The device includes a clamping member which secures the gem into a ring from behind. The clamping member is hingedly attached to the ring.

In these and other prior jewelry devices having removable and replaceable ornaments (coins, stones, gems, etc.), several deficiencies arise. First, the mechanism that secures the ornament to the device tends to loosen over time. This results in the ornament being loosely retained in the device; the ornament will tend to rattle in the device, may become misaligned, and may even fall out of the device, all deleterious events. The constant rattle can also harm the ornament contained inside.

Second, in these devices, assuming the mechanism is nominally secure, the ornament is typically difficult to remove from the device. In many instances, the securing mechanism is locked into place with a friction fit. To open the securing mechanism to release the ornament, typically one must obtain a finger purchase on a very small tab or protrusion on the securing mechanism and pry it open. Since these tabs are generally mere millimeters in size, one must usually open the securing mechanism only with one's fingernails, a process which tends to chip or break one's fingernails. Moreover, when one is struggling with the device to open it, one frequently loses one's grip on the device when it opens, and the ornament falls to the floor, possibly becoming lost or damaged in the process.

Third, moisture can enter the chamber or recess in which the ornament is disposed, either when the wearer washes his hands, swims, or simply perspires. If moisture, particularly perspiration, remains in the recess behind the ornament, mold, mildew, or fungus may develop in and on the jewelry device. The jewelry may obtain an unpleasant odor or it may begin to change color.

SUMMARY OF THE INVENTION

Accordingly, it is an object of the invention to provide a jewelry device having interchangeable ornaments from which the ornaments may be easily removed.

It is another object of the invention to provide a jewelry device having interchangeable ornaments in which the ornament is firmly secured, does not rattle, become dislodged, or fall out.

It is another object of the invention to provide a jewelry device having interchangeable ornaments which prevents moisture from building up behind the ornament.

The above and other objects are fulfilled by the invention, which is a jewelry device having interchangeable ornaments. A main base of the device has a recess adapted to receive a removable ornament. The main base has a top side and a bottom side and a flange formed on an interior of the top side within the recess. The flange retains an ornament and prevents it from falling out of the top of the device. A securing door is attached to an exterior of the bottom side of the main base. The securing door has a top side facing the recess and a bottom side opposite the top side. The securing door is movable between a closed position substantially in contact with the main base and an open position. A spring, preferably a leaf spring, is attached, preferably at one end, to the top side of the securing door. The leaf spring is adapted to bias against a removable ornament disposed in the recess when the securing door is in the closed position and thus prevent it from rattling, becoming misaligned, or falling out. Preferably, the securing door is hingedly attached to an exterior of the bottom side of the main base and hingedly swings between the open and closed positions.

The device preferably has attachment means for enabling a person to secure the jewelry device on the body of the person. The attachment means may include a ring shank pivotally attached to the main base, the main base being rotatable with respect to the ring shank. The device may be worn as a ring by placing a finger between the ring shank and the main base. Alternatively, the securing door can be formed to curve inwardly toward the recess, and the attachment means may include a second securing door attached to the exterior of the bottom side of the main base, the second securing door movable between a second closed position substantially in contact with one of the main base and the securing door and a second open position. The device may be worn as a pendant by placing a chain between the securing door when the securing door is in the closed position and the second securing door when the second securing door is in the second closed position.

The inventive jewelry device further includes a removable insert adapted to be placed inside the recess of the main base. The insert has an ornamental surface on one side and a step formed around a perimeter of the ornamental surface, the step engaging the flange of the main base when the insert is disposed in the recess. When the insert is disposed in the recess, the ornamental surface provides a neat, substantially seamless finish with an outermost position of the top side of the main base. The ornamental surface may be flush with the top side of the main base or it may extend above the top side of the main base, as with a cabochon stone. The insert preferably includes a rim circumferentially surrounding and protecting an ornamental object, the step being formed in the rim. The rim is preferably made of metal.

In another aspect of the invention, the insert preferably further includes a backing formed across a second side of the insert opposite the ornamental surface. The backing may be a solid sheet across the rear of the insert, or it may be crossbar. The backing is preferably disposed away from and not in contact with the ornamental object. When the insert is disposed in the recess and the securing door is in the closed position, the leaf spring contacts the backing and exerts spring force on the insert thereby pressing the step of the rim of the ornament against the flange of the main base to ensure that the ornamental surface is even with the front of the jewelry device without any appreciable gaps and to ensure the insert does not rattle loosely inside the recess. Also, by providing the backing, the actual ornamental piece (e.g., a stone, gem, etc.) need not be the size of the recess but may instead be very thin; the pressure from the leaf spring on the backing insures that, from the front, the stone fills the ring well. The pressure of the leaf spring is received by the backing and not the thin stone or gem.

The securing door may further include a plurality of vents in communication with the recess when the securing door is in its closed position. The vents, preferably in the form of a filigree, allow moisture which may enter the recess to escape easily.

DETAILED DESCRIPTION OF THE PREFERRED EMBODIMENTS AND THE DRAWINGS

Description of the invention will now be given with reference to the attached FIGS. 1–6. The Figures are for illustrative purposes only and are not in any way meant to limit the scope of the invention, which is defined by the claims appended hereto.

Figure 1A:
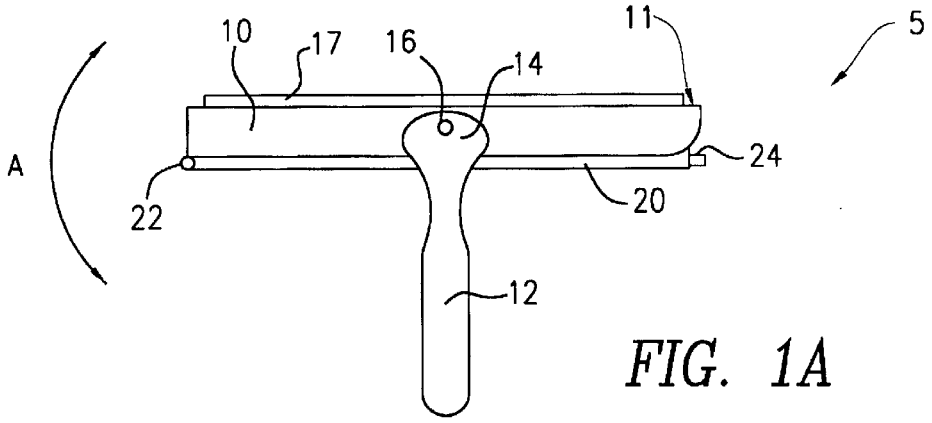
FIG. 1A is a side elevational view of a first embodiment of the invention as a ring.
Figure 1B:
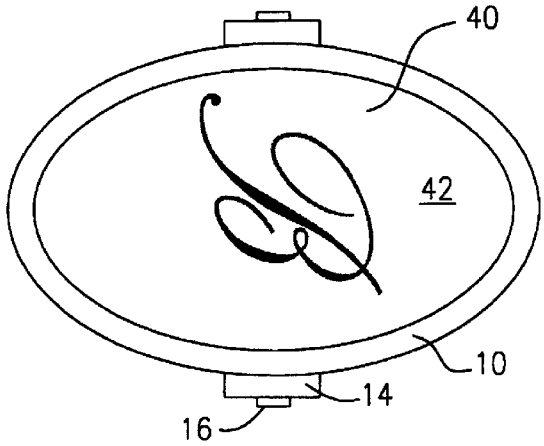
FIG. 1B is a top elevational view of the ring of FIG. 1A.
Figure 1C:
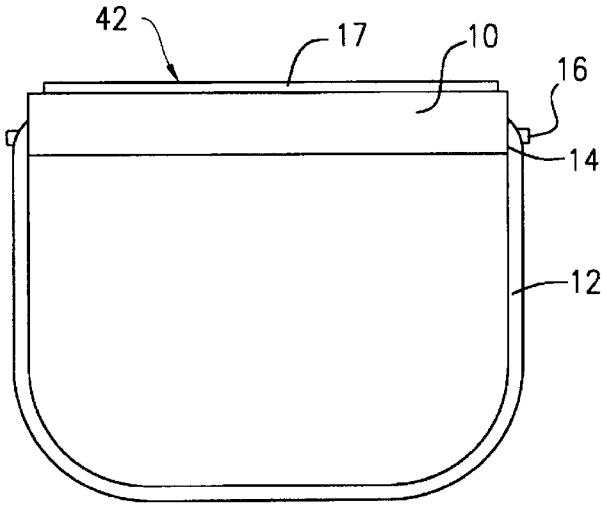
FIG. 1C is a front elevational view of the ring of FIG. 1A.
Figure 2:
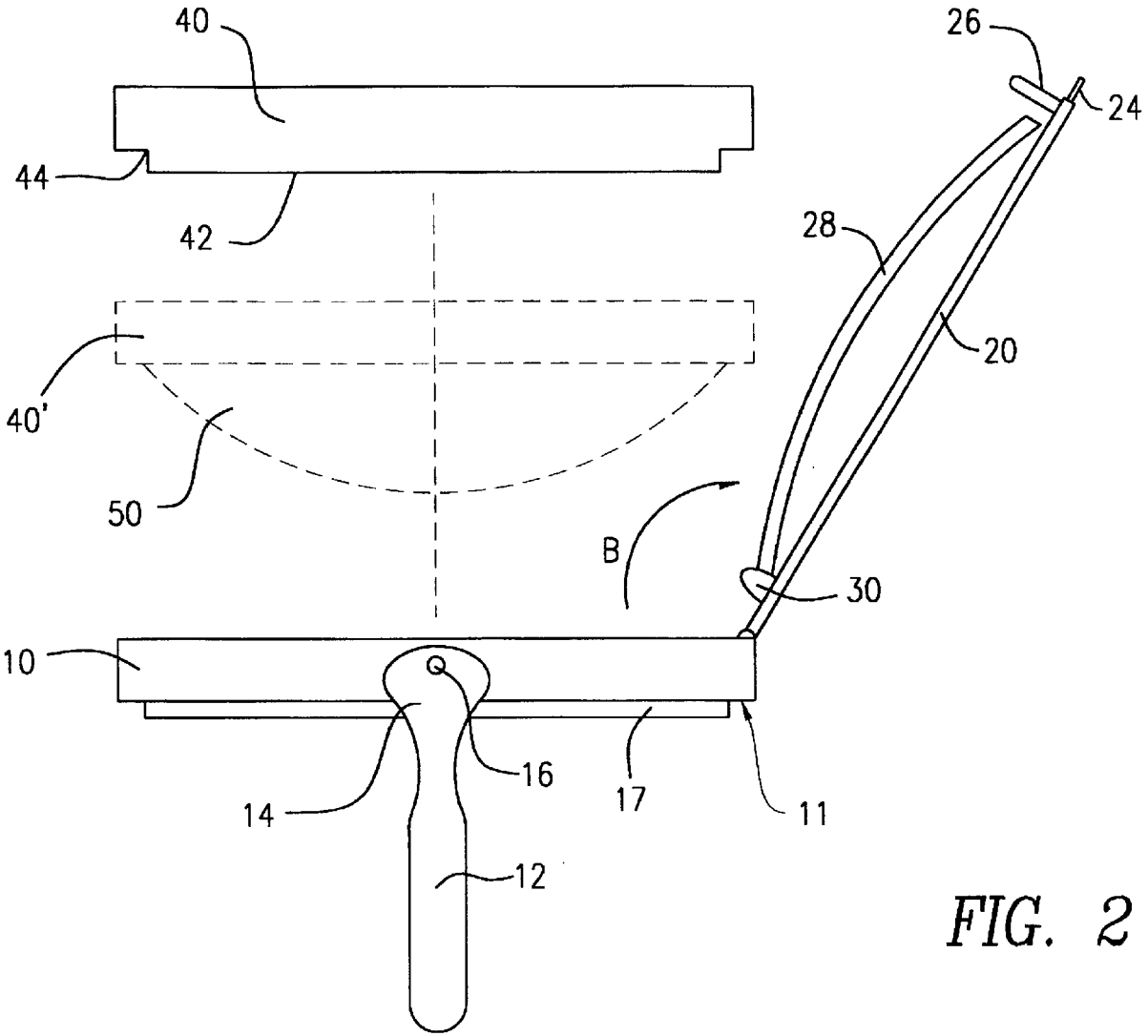
FIG. 2 is a partially exploded side elevational view of the ring of FIG. 1 with the main base inverted (pivoted 180° about its pins) and the securing door in an open position.
Figure 3:
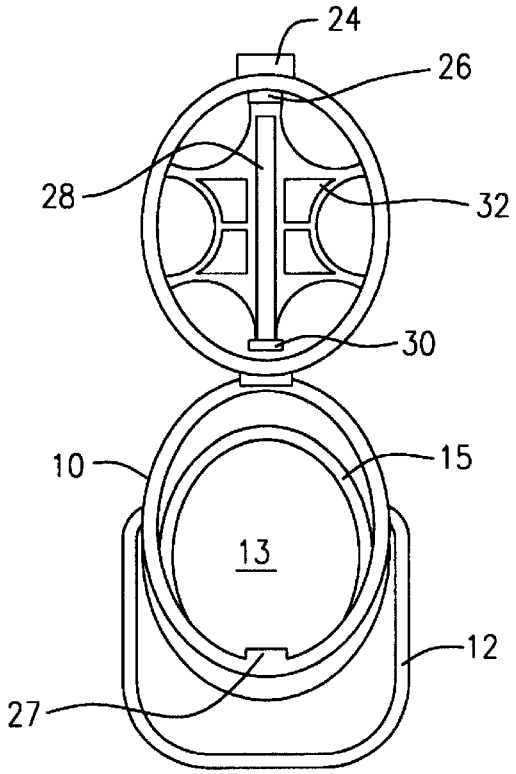
FIG. 3 is a top perspective view of the ring of FIG. 2.

As shown in FIGS. 1–3, the inventive jewelry device 5 includes a main base 10 and a means of attaching the device onto a person's body. In the first embodiment shown in FIGS. 1–3, the jewelry device 5 is a ring, and the attachment means is a ring shank 12. Ring shank 12 is pivotally attached at shank ends 14 to main base 10. Pins 16 connect the shank ends 14 to main base 10. FIG. 1 depicts pins 16 as passing through their respective shank ends 14, however it is actually preferable to provide pins 16 as outwardly pointing projections from main base 10 that fit into corresponding receiving holes (not shown) in shank ends 14. The reverse is also feasible, i.e., the provision of pins extending from shank ends 14 into receiving holes (not shown) in main base 10. In any case, ring shank 12 is pivotally attached to main base 10 and is allowed to rotate around pins 16 as depicted by arrow A in FIG. 1A; preferably the main base and ring shank are allowed to rotate a full 360° degrees with respect to each other. Main base 10 is substantially hollow and includes recess 13 for reasons which will be made clear below. Moreover, the top side 11 of main base 10 is substantially open; a circumferential flange 15 is disposed along an inner perimeter of top side 11 just within recess 13. Flange 15 may be formed integrally with main base 10, or it may be made as a separate element 17 which is soldered or otherwise affixed onto top side 11 of main base 10. Flange element 17 may extend upwards from top side 11 or it may be flush with top side 11.

On the bottom or rear portion of main base 10 is disposed a securing door 20. Securing door 20 is attached at one end to main base 10 by hinge 22. As shown in FIG. 2, on the opposite end of securing door 20 is a finger tab 24 and a post 26. Finger tab 24 is formed on or near the outside or perimeter of securing door 20 and provides the user with the ability to open securing door 20 by prying it off of main base 10. When securing door 20 is closed against main base 10 (as shown in FIG. 1, for example), post 26 abuts an inner surface of main base 10 inside recess 13 to hold securing door closed. Post 26 may have a simple friction fit with main body 10, or it may preferably be provided with a tooth or notch (not shown) which catches on an edge of notch 27 provided in main base 10 to "click" or "snap" into place. Finger tab 24 and hinge 22 are shown in the drawings as protruding from main base 10, however these elements are shown to protrude only to illustrate their structure more clearly; in the preferred embodiment, both elements are respectively flush with main base 10.

The purpose of recess 13 is to accommodate a removable, replaceable jewelry insert 40, as shown in FIG. 2. The insert can be made of any material known to be used in the jewelry arts, e.g., a gemstone, zirconia, a precious metal, pearl, onyx, jade, paste, a "cameo stone", etc. Insert 40 is provided with an ornamental surface 42 which is intended to be displayed through the open portion of top side 11 of main base 10. As shown in FIG. 2, insert 40 is placed inside recess 13 of main base 10 so that the ornamental surface 42 is showing through top side 11 (in FIG. 2, main base 10 has been inverted by pivoting it around pins 16 so that the top side 11 is facing downwards towards ring shank 12). The stone may be flat, as shown in insert 40, or it may be rounded and extend above top side 11 when seated, as shown in insert 40'. In both cases, insert 40 is provided with a circumferential step 44 which is designed to abut and engage flange 15 in main base 10. By providing step 44 in insert 40 and flange 15 in main base 10, ornamental surface 42 of insert 40 is secured substantially seamlessly with top side 11 as shown in FIG. 1B with no gaps between main body 10 and stone 50. The result is a cleaner, smoother finish on the top of the jewelry device which makes the invention otherwise indistinguishable from conventional jewelry.

Securing door 20 insures that insert 40 does not fall out of the back of the device. This feature is important if the device is a ring and is removed from the wearer's hand or if it is a different kind of ornament not pressed against the wearer's body, as will be discussed below with respect to FIGS. 6–7. As illustrated in FIGS. 2 and 3, securing door 20 is provided with a leaf spring 28 connected in a cantilever manner (i.e., attached at one end and free at the other end) to the inside surface of securing door 20 by spring mount 30. The leaf spring shown in the Figures is attached to securing door 20 at or near the same end of securing door 20 that is hingedly attached to main base 10. That which is depicted is merely one embodiment; it is contemplated that the attaching of the leaf spring in the opposite configuration with its spring mount 30 disposed opposite the hinged end of securing door 20 is also within the scope of the invention. It is preferable to mount leaf spring 28 so that its free end is close to frictional post 26, as will be explained below.

When an insert 40 is disposed inside recess 13 and securing door 20 is closed, leaf spring 28 presses against the rear surface (the surface opposite the ornamental surface) of insert 40 to press it snugly against flange 15. The pressure created by the spring force of leaf spring 28 insures that the ornamental surface 42 of insert 40 is substantially seamless with top surface 11 of main base 10. Leaf spring 28 also enables the user to open securing door 20 in a "fingernail-friendly" fashion. One has the option of prying securing door 20 off of main base 10 by placing a fingernail or part of a finger under finger tab 24 and pulling up on it, i.e., away from main base 10. However, if the user has long fingernails, her fingernail might chip or crack while attempting prying securing door 20 open. Instead, she may press down on ornamental surface 42 while holding main base 10. The force applied by her finger against ornamental surface 42 is transmitted through insert 40 to push against securing door 20. It is easy to generate sufficient force in this manner to overcome the frictional forces of frictional post 26 abutting against an inner surface of main base 10. Some pressing force is transmitted through leaf spring 28, depending upon where on the ornamental surface a person pushes. It is preferred that the user press down on the ornamental surface at a point closest to the post 26. Pressing in that location maximizes the amount of leverage with respect to the hinge (and thus maximizes the ease of removing the stone), while placing a lower amount of stress and wear on leaf spring 28 than if one pressed on the center of the stone.

As mentioned above and as shown in the Figures, in the preferred embodiment, leaf spring 30 is mounted with its free end close to frictional post 26. When a user presses on the ornamental surface to remove the insert, or when the user accidentally bangs the device against a hard object such as a table or a door, leaf spring 28 will be pressed downwards against securing door 20; as a result, the free end of the leaf spring will move closer to and eventually abut frictional post 26. Thus, frictional post 26 serves to delimit the amount that leaf spring 28 may flex and thus delimits the amount of spring force the leaf spring can transmit. This limitation of leaf spring 28 is helpful in preventing insert 40 from flying out of the jewelry device when the device is struck accidentally or when intentionally pressed by the user.

Securing door 20 may be solid or it may be provided with vents. Main base 10 has a significant amount of empty space inside, even when an insert is disposed therein. A wearer who washes her hands or goes swimming while wearing the ring may introduce water to the interior of main base 10. Also, if the wearer perspires a great deal, perspiration may be introduced inside main base 10. If moisture remains inside main base 10, mold or mildew can begin to form. As shown in FIG. 3, securing door 26 is provided with filigree 32. The filigree enables moisture that has entered main base 10 to evaporate.

Figure 4:
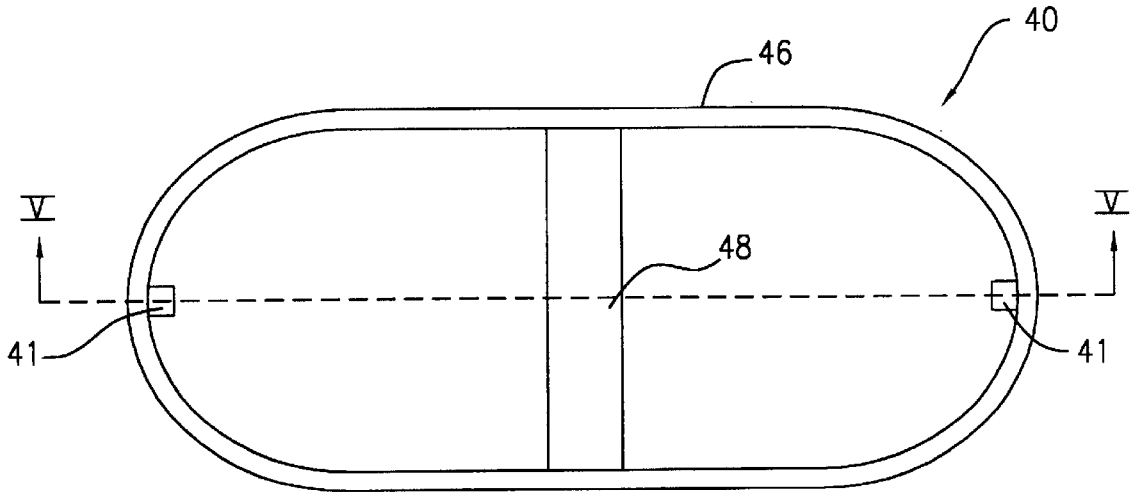
FIG. 4 is a r ear elevational view of an embodiment of the inventive ornamental insert of the invention.

Insert 40 may be one of several different embodiments. The most basic version of insert 40 is simply a solid piece of stone or gemstone (not shown). The stone or gemstone should be carefully cut to fit in recess 13 and abut flange 15. The stone or gemstone should also be provided with step 44 so the ornamental surface 42 of the insert will be gapless with the top surface 11 and/or piece 17 of main base 10 when step 44 is captured on flange 15. As shown in FIGS. 4–5, in the preferred embodiments of the insert, insert 40 is provided with a harness or rim 46 which surrounds and protects the stone or gemstone 50. Preferably, the circumferential rim is made from a metal, since metals are easy to shape and machine. Step 44 may be readily formed in rim 46 more easily than in the stone or gemstone directly. Pegs 41 (see FIG. 4) are also preferably provided to support the stone from underneath. The stone is placed through the top of rim 46, and the back or bottom surface of the stone rests on pegs 41. Two pegs 41 are shown in FIG. 4, however, any convenient number may be employed. The upper portion of rim 46 is preferably provided with a bezel that crimps over the top of the stone.

Rim 46 may also include a crossbar 48 which passes across the rear portion of the rim. Crossbar 48 provides a raised portion of insert 40 to insure better contact between insert 40 and leaf spring 28. Additionally, by providing crossbar 48, preferably a distance away from or above the stone, stone or gemstone 50 need not be the entire thickness of insert 40. As a result, a smaller amount of precious or semi-precious material is required for the insert, and costs may be reduced dramatically. Leaf spring 28 will still press against crossbar 48 and push ornamental surface 42 even with the top of the main base without a gap showing between main base 10 and ornamental surface 42. Rim 46 is typically provided with a circumferential wall 49 to which crossbar 48 is attached. Rim 46 is attached to stone 50 via gluing, press-fitting, soldering, or any of the conventional methods of attaching items in jewelry.

Figure 5A:
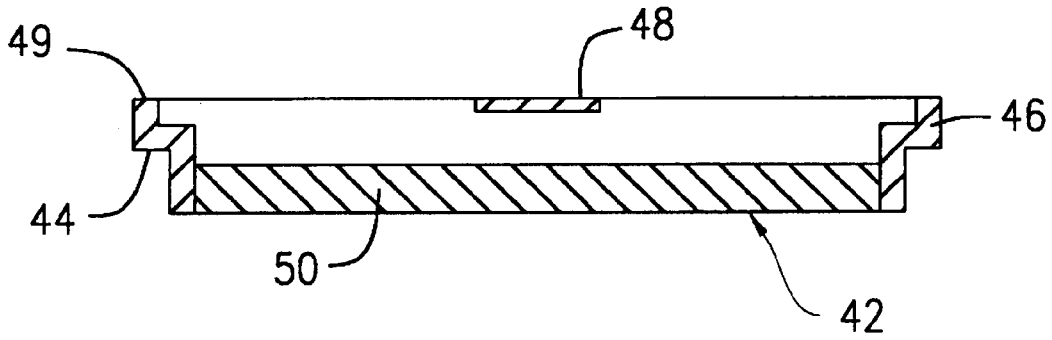
FIG. 5A is a side sectional view of an inventive ornamental insert taken along line V—V shown in FIG. 4.
Figure 5B:
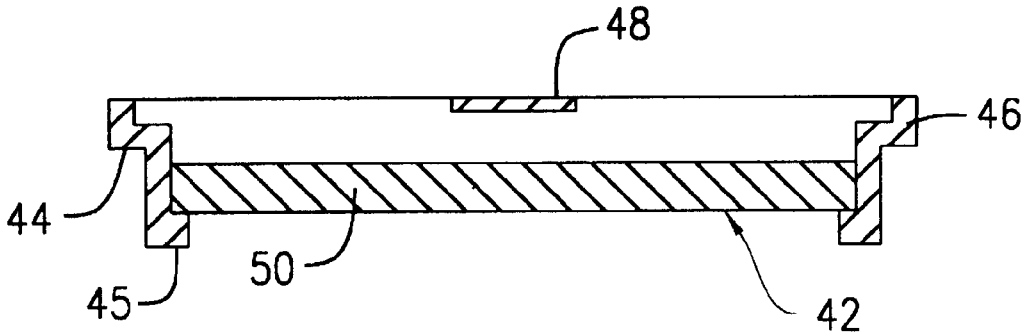
FIG. 5B is a side sectional view of another, preferred version of the inventive ornamental insert taken along line V—V shown in FIG. 4.

FIGS. 5A–B show two different versions in section of the inventive insert 40. In FIG. 5A, stone 50 is press-fit inside rim 46. The preferred insert is shown in FIG. 5B: rim 46 includes a bezel 45 as described above which is crimped over the edges of the stone 50 and helps to retain and secure stone 50 inside. Bezel 45 may be provided along the entire circumference of rim 46 or it may be provided in a prong fashion at a number of discrete locations around the circumference.

Figure 6A:
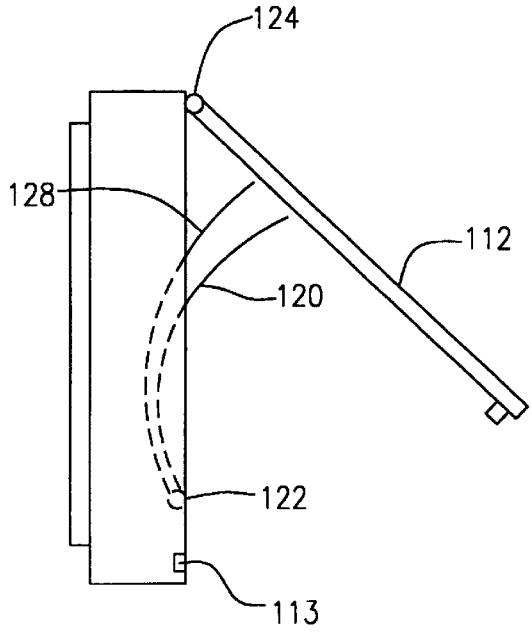
FIG. 6A is a side elevational view of a second embodiment of the invention as a pendant with securing doors in an open position.
Figure 6B:
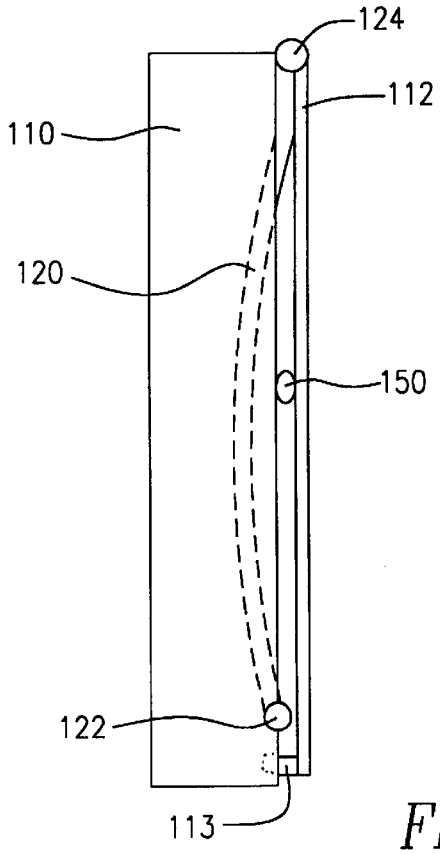
FIG. 6B is a side elevational view of the pendant of FIG. 6A with both securing doors in a closed position.
Figure 7:
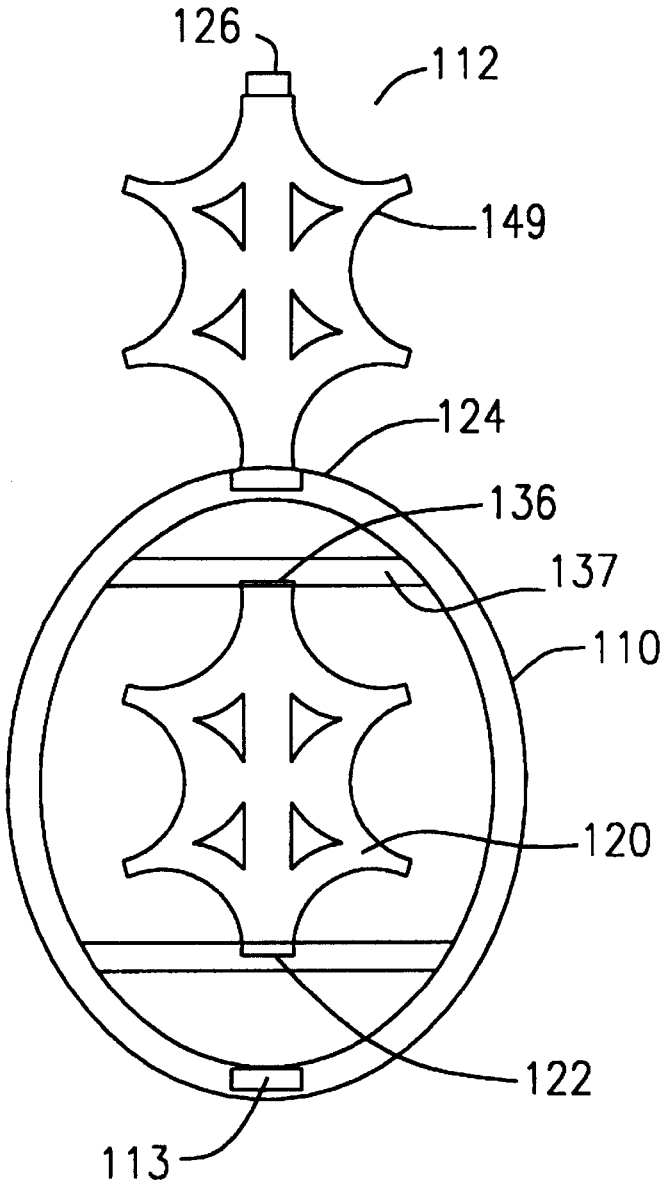
FIG. 7 is a top perspective view of the pendant of FIGS. 6A–B.

FIGS. 6–7 depict a second embodiment of the invention as pendant 105. Main base 110 is similar to base 10 of the ring described above; i.e., it is substantially hollow, it includes a recess and a flange (not shown), etc. It, too, is capable of receiving any one of a plurality of interchangeable inserts 40. Pendant 105 is provided with securing door 120 which includes leaf spring 128. Securing door 120 is attached to main base 110 via hinge 122. The securing door and leaf spring of pendant 105 function in the same way as their counterparts in ring 5. In pendant 105, however, securing door 120 is curved inwards towards main base 110. First door 120 includes a post 136 which engages crossbeam 137 to click door 120 closed. A second securing door 112 is attached to main base 110 via hinge 124. It folds over the rear surface of main base 110 and, owing to the curvature of securing door 120, leaves a space between itself and securing door 120. As shown in FIG. 6B, a chain or necklace 150 may be disposed in the space between the securing doors 112, 120 so that the pendant may be hung around the wearer's neck, wrist, ankle, or waist. The non-hinged end of second securing door 112 may be secured to main base 110 by post 126 encounter notch 113. Leaf spring 128 is substantially similar to leaf spring 28 except that it is curved like door 120. Post 126 is substantially similar to post 26. Second door 112 may include cut out portions 149 to accommodate chain 150 more easily.

The invention is not limited to the above description but rather is defined by the claims appearing hereinbelow. Modifications to the above description that include that which is known in the art are well within the scope of the contemplated invention. For example, in addition to being a ring or a pendant, the invention may take on the form of a pin, brooch, tie-tack, earring, hair clip, belt buckle, or any other ornamental device. Also, the securing doors above were described as being closed via a frictional securing mechanism. However, any form of known jewelry clasp or closure system will serve to close the securing doors. Also, the shape of the device can be changed from the oval shown in FIGS. 1–4 to any other shape without departing from the invention, and the orientation of the oval can be rotated to lie horizontally instead of vertically as shown.

What is claimed is:

1. A jewelry device having interchangeable ornaments, comprising:

a main base having a recess adapted to receive a removable ornament, said main base having a top side and a bottom side and an inwardly directed flange formed on said top side within said recess;

a securing door attached to said bottom side of said main base, said securing door having a top side facing said recess and a bottom side opposite said top side, said securing door being movable between a closed position substantially in contact with said main base and an open position; and a cantilever leaf spring attached only at one end to said top side of said securing door, wherein said leaf spring is adapted to bias against a removable ornament disposed in said recess when said securing door is in said closed position.

2. A jewelry device having interchangeable ornaments according to claim 1, wherein said securing door is hingedly attached to said bottom side of said main base and hingedly swings between said open and closed positions.

3. A jewelry device having interchangeable ornaments according to claim 1, further comprising attachment means for enabling a person to secure said jewelry device on the body of the person.

4. A jewelry device having interchangeable ornaments according to claim 1, further comprising a locking piece disposed on said securing door, said locking piece frictionally abutting a portion of said main base when said securing door is in said closed position.

5. A jewelry device having interchangeable ornaments according to claim 4, wherein said locking piece is disposed on said top side of said securing door and said leaf spring extends substantially parallel to said securing door, said leaf spring having a fixed end and a free end, said free end being disposed near said locking piece.

6. A jewelry device having interchangeable ornaments according to claim 1, further comprising a removable insert adapted to be placed inside said recess of said main base, said insert having an ornamental surface on one side and a step formed around a perimeter of said ornamental surface, said step engaging said flange when said insert is disposed in said recess, wherein when said insert is disposed in said recess, said ornamental surface is substantially seamless with an outermost portion of said top side of said main base with substantially no gap formed between said ornamental surface and said top side of said main base.

7. A jewelry device having interchangeable ornaments according to claim 6, wherein said insert comprises a metal rim circumferentially surrounding an ornamental object, said step being formed in said metal rim.

8. A jewelry device having interchangeable ornaments according to claim 7, said insert further comprising a backing formed across a second side of said insert opposite said ornamental surface.

9. A jewelry device having interchangeable ornaments according to claim 1, said securing door further comprising a plurality of vents in communication with said recess when said securing door is in its closed position.

10. A jewelry device having interchangeable ornaments according to claim 1, wherein said leaf spring extends substantially parallel to said securing door.

11. A jewelry device having interchangeable ornaments comprising:

a main base having a recess adapted to receive a removable ornament, said main base having a top side and a bottom side and an inwardly directed flange formed on said top side within said recess;

a securing door attached to said bottom side of said main base, said securing door having a top side facing said recess and a bottom side opposite said top side, said securing door being movable between a closed position substantially in contact with said main base and an open position;

a leaf spring attached at one end to said top side of said securing door; and attachment means for enabling a person to secure said jewelry device on the body of the person, said attachment means comprising a ring shank pivotally attached to said main base, said main base being rotatable with respect to said ring shank, wherein said leaf spring is adapted to bias against a removable ornament disposed in said recess when said securing door is in said closed position, and wherein said device may be worn as a ring by placing a finger between said ring shank and said main base.

12. A jewelry device having interchangeable ornaments, comprising:

a main base having a recess adapted to receive a removable ornament, said main base having a top side and a bottom side and an inwardly directed flange formed on said top side within said recess;

a securing door attached to said bottom side of said main base, said securing door having a top side facing said recess and a bottom side opposite said top side, said securing door being movable between a closed position substantially in contact with said main base and an open position;

a leaf spring attached at one end to said top side of said securing door; and attachment means for enabling a person to secure said jewelry device on the body of the person, said securing door being curved inwardly toward said recess, said attachments means comprising a second securing door attached to said bottom side of said main base, said second securing door movable between a second closed position substantially in contact with one of said main base and said securing door and a second open position, wherein said leaf spring is adapted to bias against a removable disposed in said recess when said securing door is in said closed position.

13. A jewelry device having interchangeable ornaments according to claim 12, wherein said device may be worn as a pendant by disposing a chain between said securing door when said securing door is in said closed position and said second securing door when said second securing door is in said second closed position.

14. A jewelry device having interchangeable ornaments according to claim 12, wherein said securing door is hingedly attached to said bottom side of said main base and hingedly swings between said open and closed positions.

15. A jewelry device having interchangeable ornaments according to claim 12, further comprising a second locking piece disposed on said second securing door, said second locking piece frictionally abutting a second portion of said main base when said second securing door is in said second closed position.

16. A jewelry device having interchangeable ornaments, comprising:

a main base having a recess adapted to receive a removable ornament, said main base having a top side and a bottom side and an inwardly directed flange formed on said top side within said recess;

a securing door attached to said bottom side of said main base, said securing door having a top side facing said recess and a bottom side opposite said top side, said securing door being movable between a closed position substantially in contact with said main base and an open position;

a leaf spring attached at one end to said top side of said securing door; and a removable insert adapted to be placed inside said recess of said main base, said insert having an ornamental surface on one side and a step formed around a perimeter of said ornamental surface, said step engaging said flange when said insert is disposed in said recess, said insert comprising a metal rim circumferentially surrounding an ornamental object, said step being formed in said metal rim, said insert further comprising a backing formed across a second side of said insert opposite said ornamental surface, said backing being spaced away from and not in contact with said ornamental object, wherein when said insert is disposed in said recess, said ornamental surface is substantially seamless with an outermost portion of said top side of said main base with substantially no gap formed between said ornamental surface and said top side of said main base, and wherein when said insert is disposed in said recess and said securing door is in said closed position, said leaf spring contacts said backing and exerts spring force on said insert thereby pressing said step against said flange.

17. A jewelry device having interchangeable ornaments according to claim 16, wherein said backing is one of a solid flat piece extending across the entire said second side of said insert and a crossbar extending across said second side of said insert.

* * * * *